United States Patent [19]

Sassmannshausen

[11] 4,307,439

[45] Dec. 22, 1981

[54] LAMP

[76] Inventor: Knut O. Sassmannshausen, 3, Rothenbach, D-6580 Idar-Oberstein, Fed. Rep. of Germany

[21] Appl. No.: 106,289

[22] Filed: Dec. 21, 1979

[30] Foreign Application Priority Data

Dec. 21, 1978 [GB] United Kingdom ..... 495/78

[51] Int. Cl.[3] ..... F21L 7/00

[52] U.S. Cl. ..... 362/186; 362/188; 362/202; 362/277; 362/285

[58] Field of Search ..... 362/186, 188, 202, 277, 362/285

[56] References Cited

U.S. PATENT DOCUMENTS 2,092,590 9/1937 Schaff ..... 362/207

2,253,952 8/1941 Desimone ..... 362/207

*Primary Examiner*—Stephen J. Lechert, Jr.

*Attorney, Agent, or Firm*—Herbert L. Lerner

[57] ABSTRACT

A lamp including a supply housing, means for supporting a bulb connectible to a power supply within the housing, a head of clear transparent material mounted on the housing, and a reflector mounted within the head and having a concave inner surface for reflecting light from the bulb along an axis, the head affording clear visibility of the exterior surface of the reflector.

18 Claims, 15 Drawing Figures

Figure 1:
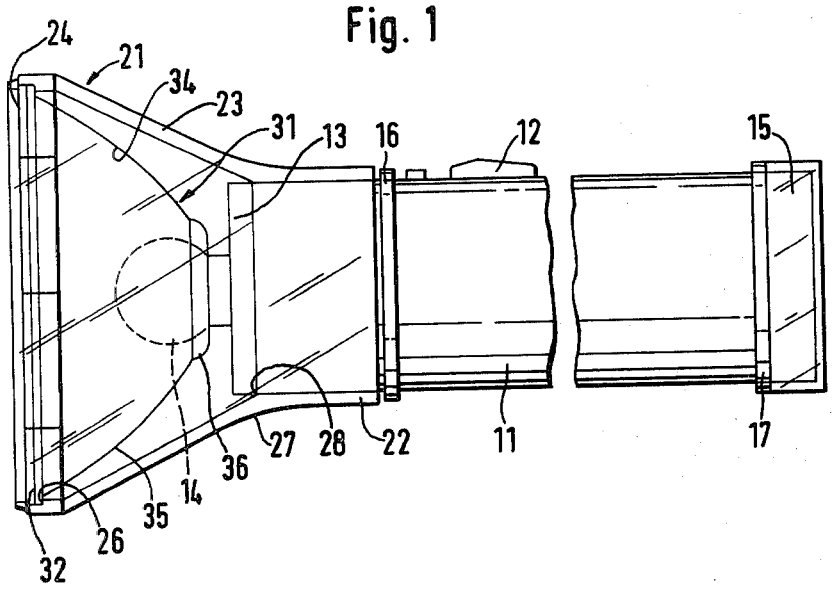

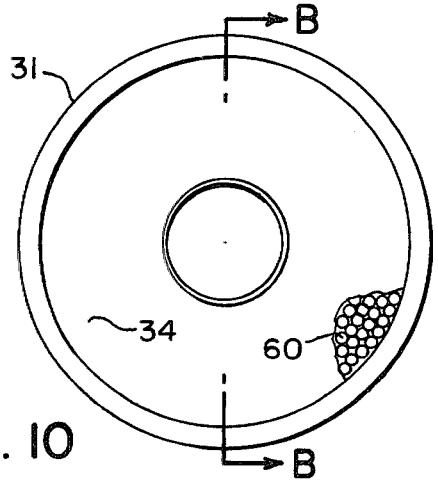
Fig. 10
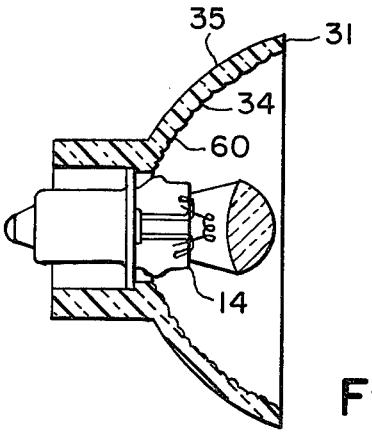
Fig. 11
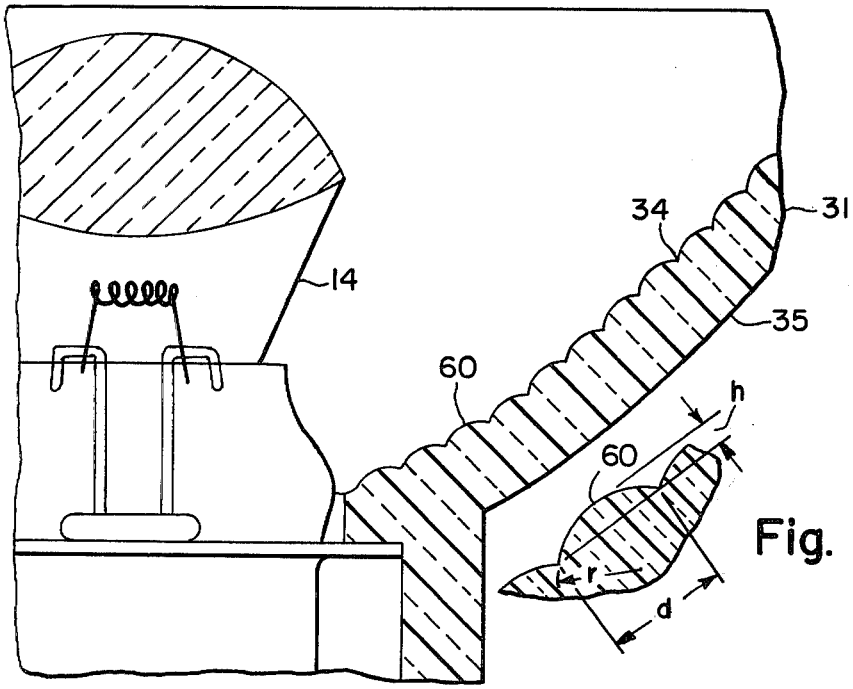
Fig. 12a
Fig. 12

LAMP

This invention relates to lamps, such as flashlights, search lights and lanterns.

Lamps usually comprise a power supply housing, a bulb holder, and a reflector for reflecting light from a bulb when energized by a power supply within the housing in a concentrated beam. The reflector usually has a reflecting surface which is a concave surface of revolution. The reflector usually has an axial aperture to receive the bulb. The reflector may be movable axially relative to the bulb to adjust the shape of the beam.

It is convenient to support the reflector around its outer edge either from the supply housing or from a head which is mounted on the housing. The head may include a transparent end window through which the light may pass and which protects the concave surface of the reflector and the bulb.

Since the luminous body of the bulb is usually contained entirely within the reflector, the material of the head or housing surrounding the convex surface of the reflector is usually opaque since there has been no need for light to pass through it. It has been proposed with flashlights, where the bulb can be moved axially relative to the reflector so that some light can escape sideways behind the reflector, to surround the convex surface of the reflector with a window of light-diffusing material so that a diffused glow from the bulb can be seen sideways through the material in the withdrawn position of the bulb when the bulb is energized.

It is an object of the invention to provide an improved lamp generally of the foregoing type which utilizes reflected light for achieving a decorative effect as well as for making the lamp more readily visible.

According to the invention there is provided a lamp comprising a supply housing, means for supporting a bulb for connection to a power supply within the housing, a head of clear transparent material mounted on the housing and a reflector mounted within the head and having a concave interior surface for reflecting light from the bulb along an axis, the head affording clear visibility of the exterior surface of the reflector. With this construction, a decorative effect is achieved by light reflected from the exterior surface of the reflector. This light may be ambient light which passes through the head, and is then reflected by the reflector back through the head again, or the light may come from the energized bulb when at least partially withdrawn from inside the reflector. The material of the head may be colored to increase the decorative nature of this effect. The effect will be increased if the exterior surface of the reflector is of a highly reflecting (i.e. specular) nature.

Besides the decorative effect, the clear transparent material of the head and the reflecting nature of the exterior of the reflector enable the flashlight to be more easily seen, independently of whether the lamp is energized or not. This provides safety for the user holding the flashlight because light will be reflected radially of the flashlight to warn, for example, a motorist approaching the user radially of the flashlight and it also assists someone in finding the flashlight because of the light reflected from it.

Other features which are considered as characteristic for the invention are set forth in the appended claims.

Although the invention is illustrated and described herein as embodied in lamp, it is nevertheless not intended to be limited to the details shown, since various modifications and structural changes may be made therein without departing from the spirit of the invention and within the scope and range of equivalents of the claims.

Figures 13, 13A:
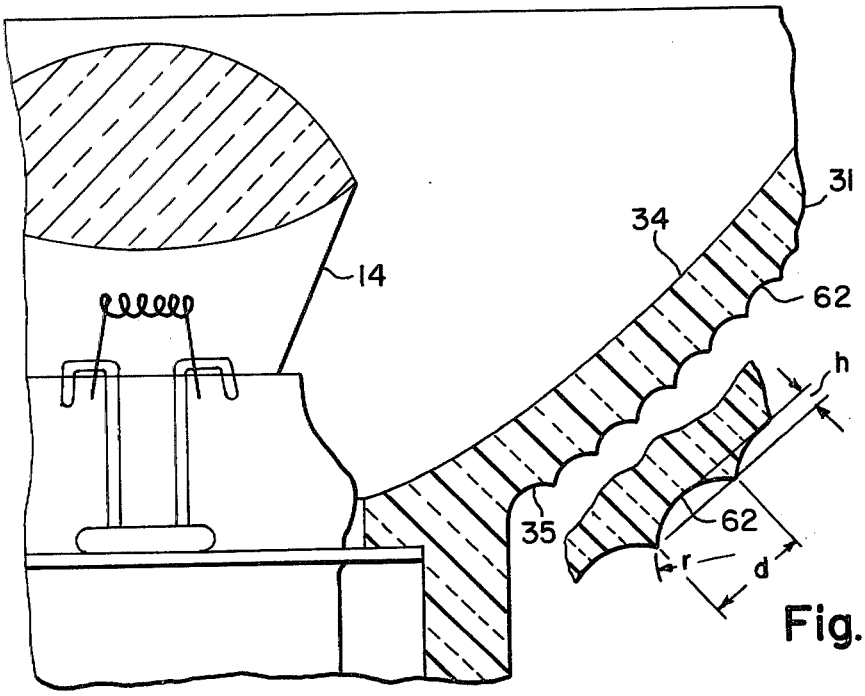

The construction and method of operation of the invention, however, together with additional objects and advantages thereof will be best understood from the following description of specific embodiments when read in connection with the accompanying drawings, in which:

FIG. 1 is a side elevational view of a flashlight constructed in accordance with the invention, FIGS. 2 to 6 are side elevational views of alternative heads for the flashlight of FIG. 1, FIGS. 7 to 9 are side elevational views partly broken away and partly in section of an alternative torch in different positions thereof, FIG. 10 is a front elevational view of a concave reflector of the flashlight, FIG. 11 is a cross-sectional view of FIG. 10 taken along the line B—B in direction of the arrows, FIG. 12 is an enlarged fragmentary view of FIG. 11 rotated counterclockwise through 90°, FIG. 12*a* is an enlarged fragmentary view of FIG. 12 showing part of the curved reflecting surface thereof, FIG. 13 is a view similar to that of FIG. 12 of another embodiment of the invention; and FIG. 13*a* is an enlarged fragmentary view of FIG. 13 showing part of the curved reflecting surface thereof.

Referring now to the drawing and first, particularly to FIG. 1 thereof, there is shown therein a flashlight according to the invention having a cylindrical battery casing 11 for two cylindrical batteries in series. A conventional switch 12 is provided on the exterior of the casing. The end 13 of the battery casing is formed as a lamp holder, in which a lamp or bulb 14 is mounted. The lamp 14 will be energized by batteries in the casing 11 when the switch 12 is closed.

On the end 13 of the battery casing 11 is a head 21. The head 21 has a cylindrical sleeve 22 fitting closely over the end 13 of the casing, and a generally frustoconical portion 23 closed off by a plane window 24 at its wider end. A reflector 31 is mounted within the frustoconical portion 23, and has a flange 32, and has a flange 32 at its mouth which is captured between the plane window 24 and a shoulder 26 near the wider end of the frustoconical portion 23. The plane window 24 is formed with ornamental rings (not shown) near its periphery on the surface facing the reflector 31 to homogize the beam. The sleeve 22 and the frustoconical portion 23 are formed of colored clear transparent material and the window 24 of uncolored clear transparent material. The material is clear so that light passes through it without diffusion except to the extent caused by imperfections in the material.

The reflector 31 is injection-molded from plastic or synthetic material generally into the shape of a parabola of revolution, with a central aperture 33 through which the bulb part of the lamp 14 may protrude. The inner concave surface 34 and the outer convex surface 35 of the reflector 31 are metallized so as to be specularly reflecting. The region 36 of the reflector 31 immediately adjacent the central aperture is of slightly greater curvature that the remainder of the general parabola, and this region 36 is lightly dimpled on its interior surface. This central region 36 is shown only in FIG. 1, but may be used in all of the heads shown in FIGS. 2 to 6, if desired.

If the plastic or synthetic material of the reflector 31 is transparent, it can be matallized on one surface only, the other reflecting face then being the interface between the plastic material and the matallization.

The flashlight will provide the best parallel light beam when the lamp filament is located at the focus of the parabola of the reflector 31. It is possible to adjust the beam by moving the lamp 14 and battery casing 11 axially relative to the head 31, and this can be achieved by moving the sleeve 22 axially relative to the battery casing 11. The axial movement can be achieved by a simple sliding movement or by a twisting movement in conjunction with a helical guide system (not shown), such as a screw thread or helical slot in the head 21 cooperating with a pin mounted on the battery casing 11.

The convex exterior reflecting surface 35 of the reflector is clearly visible through the transparent material of the frustoconical portion 23 of the head 21. Ambient light is reflected back to the observer by the exterior reflecting surface 35, and will be colored by the double passage through the colored material of the head. This gives a decorative effect and also ensures that the flashlight can be seen even when viewed from a direction in which the beam of light generated by the lamp 14 in the flashlight is not visible. The convex exterior surface 35 of the reflector 31 can be clearly seen in all directions transverse to the axis of the flashlight since the frustoconical portion 23 of the head 21 is uniform around the axis.

If the lamp 14 is withdrawn at least partially from the reflector 31 and energized, then light from the lamp 14 will also be reflected from the surface 35 of the reflector 31 and will be colored by its passage through the wall of the frustoconical portion 23.

The other end of the battery casing 11 is closed by a screw cap 15 of the same colored clear material as that of the head 21. The casing 11 is formed with raised ribs 16, 17 which act as stops, respectively, for the axial movement of the head 21 and for the screw cap 15.

The flashlight thus far described is common to all the embodiments illustrated, although it should not be inferred that all the features so far described are essential to the invention.

The head 21 shown in FIG. 1 has an outer periphery of uniform polygonal cross-section at the wide end of the frustoconical portion 23, to prevent rolling of the flashlight when it is laid down on its side. A ten-sided polygon is convenient.

At the transition 27 between the narrow end of the frustoconical portion 23 and the sleeve 22, the outer surfce of the head 21 smoothly curves from one to the other. There is a sharp transition 28 on the inner surface of the head 21.

Figure 2:
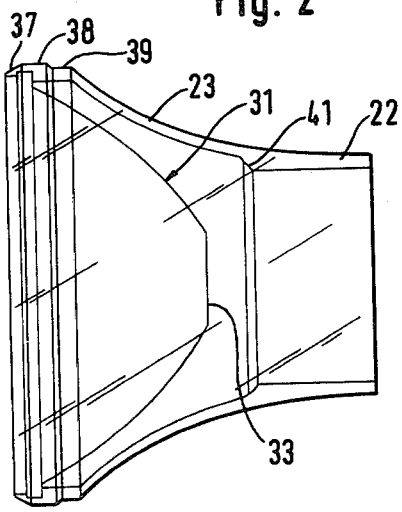

In the head shown in FIG. 2, the polygonal cross-section of the outer periphery is replaced by circular cross-sections, the transverse section tapering outwardly at 37 back from the end of the head, then having two stepped regions 38 and 39 of uniform radius until the generally frustoconical region 23 is reached. In this embodiment of FIG. 2, the main portion of the head is only generally frustoconical, its outer surface being smoothly curved with concave section from the portion 39 of uniform radius to the far end of the sleeve 22. The interior of the sleeve 22 is still cylindrical, after which the interior surface tapers rapidly outwards at 41 and then follows the curved shape of the exterior with approximately uniform thickness of material between the surfaces.

Figure 3:
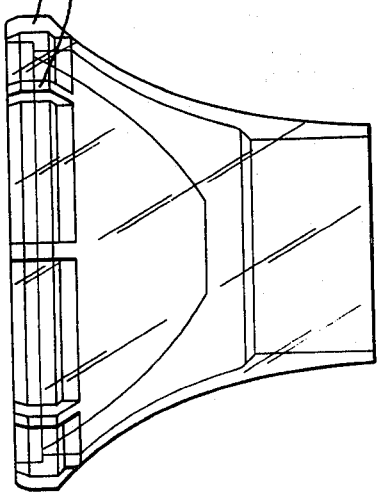

The head of FIG. 3 is similar to that of FIG. 2 except that axial ribs 42 are provided at 45 degree intervals around the periphery of the widest portion of the head. These ribs 42 provide a more positive anti-rolling device than the polygonal section of the embodiment of FIG. 1.

Figure 4:
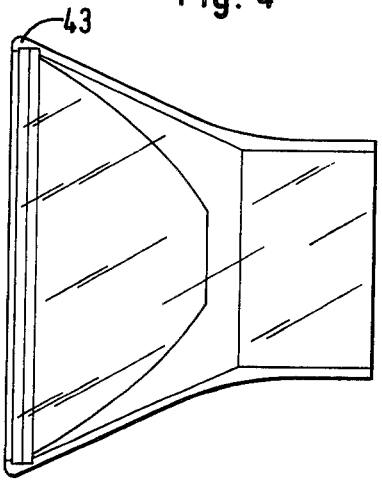

The head of FIG. 4 is similar to that of FIG. 1 except that the frustoconial external surface of the head extends to a circular rim 43 and there is no polygonal section at the rim.

Figure 5:
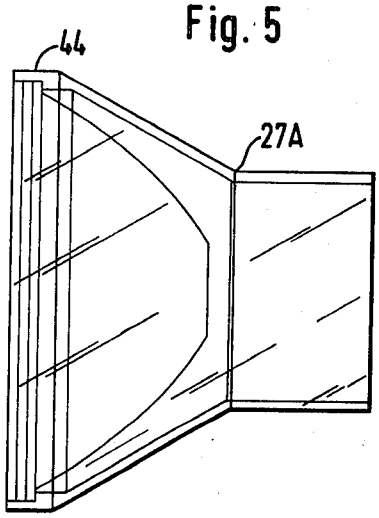

In FIG. 5 there is shown a head with a sharp transition at 27A between the sleeve and the frustoconical portion on the exterior surface and a cylindrical exterior surface 44 at the widest portion.

Figure 6:
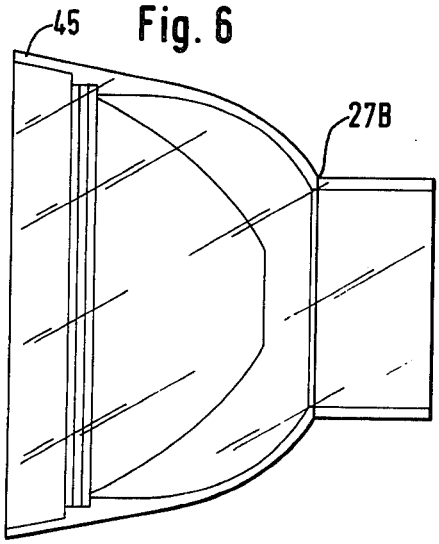

FIG. 6 shows a double-convex exterior surface to the generally frustoconical portion (as distinct from the concave longitudinal section in FIGS. 2 and 3), and the portion extends well beyond the plane window to provide a protective rim 45. There is a sharp transition to the sleeve on the exterior surface at 27B.

The flashlight head 21 may be of any convenient color, such as red, green and yellow, and it may even be partly colored or uncolored. The battery casing 11 is preferably of silver color, and may be of brushed aluminum, and the switch 12 is preferably of gold color.

The visibility of the reflector 31 is not seriously affected by the differences in shape of the head 21.

Figure 7:
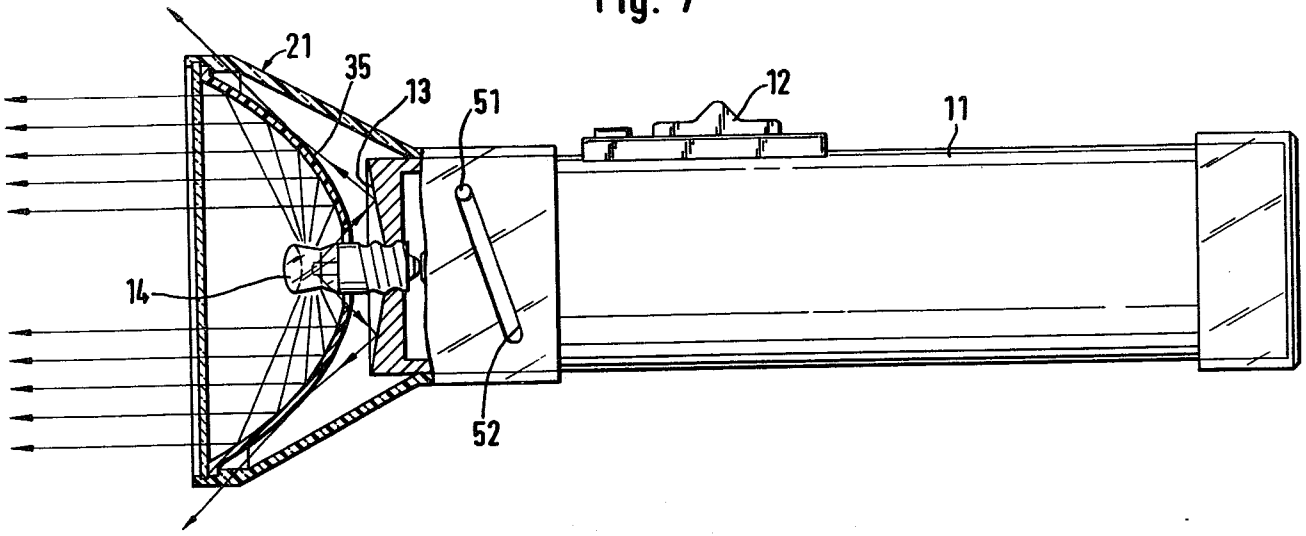
Figure 8:
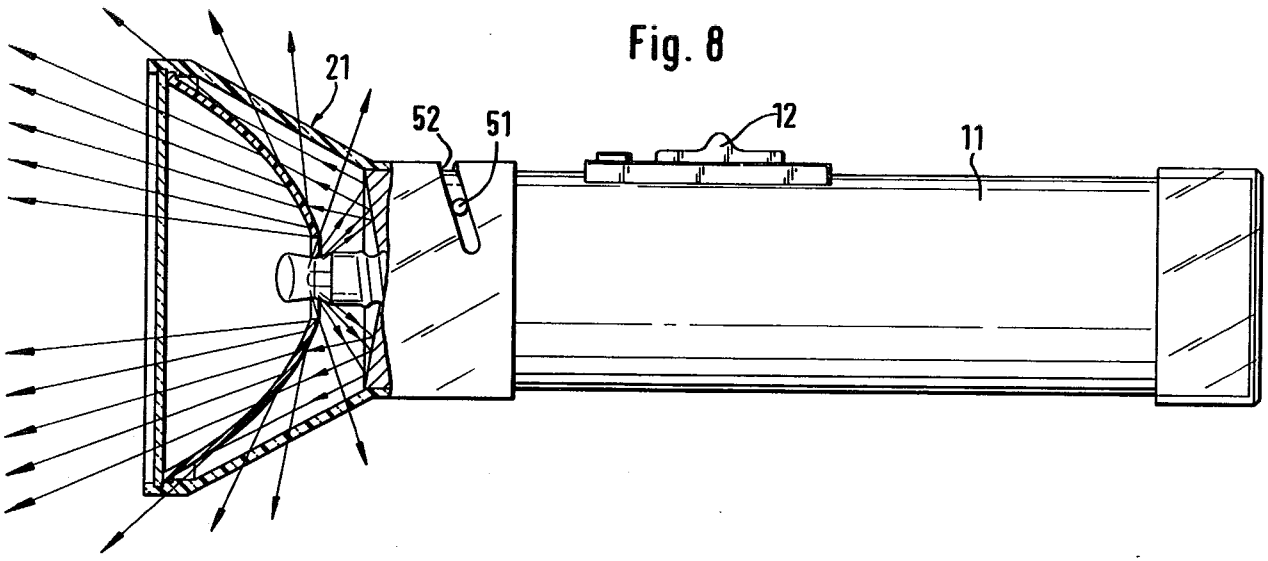
Figure 9:
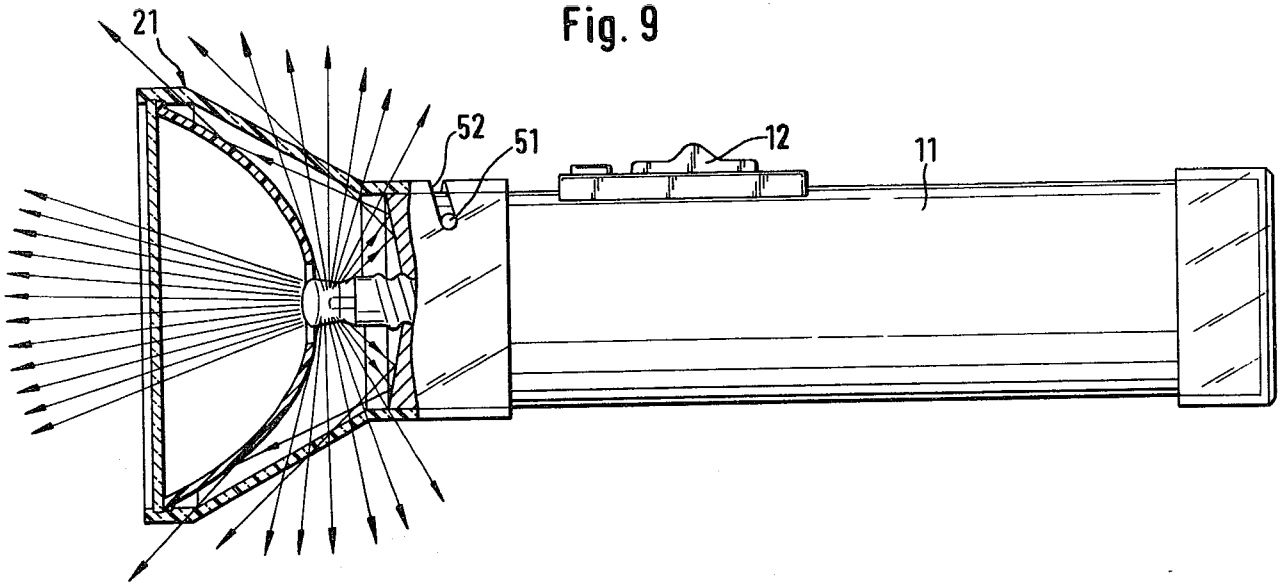

FIGS. 7 to 9 show a flashlight with a head 21 which is axially movable relative to the casing 11. The axial movement is achieved by twisting the head 21 relative to the casing 11, the casing 11 being provided with a pin 51 cooperating with a helical guide slot 52 in the cylindrical portion 22 of the head 21. FIG. 7 shows the head 21 in an extreme position in which the luminous body of the bulb 14 is located wholly within the reflector 31, and FIG. 9 shows the other extreme position in which the filament of the bulb 14 and most of the luminous body of the bulb 14 are located outside the reflector 31. It is apparent that the pin 51 is located at opposite ends of the slot 52 in FIGS. 7 and 9. FIG. 8 shows an intermediate position.

The bulb 14 shown in FIGS. 7 to 9 is provided with an integral converging lens which serves to provide an axial beam independently of the reflector 31. This beam is directed forwardly along the axis of the flashlight independently of the position of the head.

There is a small annular space between the bulb 14 and the central aperture 33 of the reflector 31. In the relative positions shown in FIG. 7, a narrow pencil of rays passes through this annular space and is reflected from a concave reflecting surface on the end 13 of the battery casing 11 onto the exterior surface 35 of the reflector 31 and thence through the exterior wall of the head 21. In the intermediate position shown in FIG. 8, the bulb 14 is further withdrawn from the reflector 31 although a majority of the luminous body of the bulb 14 still remains within the reflector 31. In this position, a wider pencil of beams falls on the reflecting end surface 13 of the battery casing 11, providing a greater spread of light reflected through the exterior wall of the head 21 by the exterior surface 35 of the reflector 31. Whereas, in FIG. 7, the filament of the bulb 14 is located at the focus of the reflector 31 so that a parallel beam of light is reflected by the surface 34 forwardly of the flashlight, in FIG. 8, the filament is displaced from the focus so that the surface 34 reflects a divergent beam forwardly of the flashlight and this is slightly reduced in intensity as some light from the bulb 14 has escaped out of the central aperture 33. In FIG. 9, the light projected forwardly of the flashlight is almost entirely from the lens of the bulb 14, little or no light being reflected from the concave surface 34 of the reflector 31. Almost all of the light from the bulb 14 passes either directly out of the wall of the head 21 or after reflection from the surfaces 13 and 35.

Instead of making the end surface 13 of the battery casing 11 reflecting, a reflecting surface could be provided by a bulbsupporting device mounted on the battery casing 11 and acting alone or together with a reflecting surface on the end of the casing 11. The forward facing surface of the bulb support or battery housing need not be specularly reflecting, but may be whitened to give diffuse reflection.

In the position shown in FIG. 7, the integral lens of the bulb 14 and the reflector 31 provide a strong forwardly directed beam from the bulb 14 when it is energized. Only a little light from the bulb 14 passes through the side walls of the head 21 to add to ambient light being reflected from the surface 35. The beam from the lens of the bulb 14 includes an angle of about 50°.

If the user requires a wider beam, the head 21 may be moved to the intermediate position shown in FIG. 8 so that the reflector 31 produces a divergent beam similar in range to that produced by the lens of the bulb 14. In this arrangement, more light escapes behind the reflector 31 to be directed through the side walls of the head 21. This may be the normal position of the flashlight when used by a pedestrian walking in an unlit area, since it will give him a fairly broad bright beam forwardly of the flashlight and will cast a sideways flow to warn others of his presence.

If the pedestrian wishes to increase the sideways glow, the position or setting of the flashlight may be moved to that shown in FIG. 9 so that all the light falling on the reflector 31 is reflected at its convex surface 35. However, the forward beam is not entirely lost, since the lens of the bulb 14 still produces the same beam.

Although the flashlight of FIGS. 7 to 9 show a head similar to that of FIG. 1, the head of any of FIGS. 2 to 6 could easily be substituted therefor.

As shown in the front elevational view of the concave reflector 31 in FIG. 10, the concave inner surface 34 of the reflector 31 has a multiplicity of small convex curved reflecting surface portions 60.

FIG. 11 is a sectional view of FIG. 10 taken along the line B—B and showing the concave reflector 31 with the reflecting inner concave surface 34 thereof formed with the multiplicity of convex curved reflecting surface portions 60. Furthermore, an incandescent lensed light bulb or lamp 14 is also to be seen therein.

In the enlarged fragmentary view of the reflector 31 of FIG. 11 shown in FIG. 12, the reflecting curved surface portions 60 are shown in greater detail.

FIG. 12*a* shows one of the reflecting curved convex surface portions 60 in yet a further enlarged view. The smallest base diameter d of the reflecting curved surface portion 60 and the height h thereof are clearly illustrated in FIG. 12*a*.

The material of the reflector 31 is transparent. A light beam going towards the outer convex surface 35 of the reflector 31 will enter the transparent material of the reflector 31 and will reach the specular reflecting inner surface 34 of the reflector 31, which may be metallized. The light beam will be reflected back through the transparent material of the reflector 31 towards the outer convex surface 35 of the reflector 31 and away from the reflector 31. The reflecting curved surface portions 60 ensure that at least some of the light going from a spectator towards the outer convex surface 35 of the reflector 31 wil be reflected back in the direction of the spectator. Good results were attained when the height h of such a curved reflecting surface portion 60 was between 3 percent and 25 percent of the smallest base diameter d thereof. The reflecting curved surface portions 60 can have the shape of a spherical cap or part of an ellipsoid or a paraboloid.

FIG. 13 shows an embodiment of the reflector 31 having curved reflecting surface portions 62 at the convex outer surface 35 thereof. The reflector 31 of FIG. 13 is specularly metallized at the inner concave surface 34 thereof as well as at the outer convex surface 35 thereof.

FIG. 13*a* is an enlarged fragmentary view of FIG. 13 showing a concave curved reflecting surface portion 62 thereof having a height h and a smallest base diameter d. The concave curved reflecting surface portions 62 ensure that some of the light going from a spectator towards such portions 62 will be reflected back towards the spectator. The curved outer surface of the paraboloid of the reflector 31 helps in obtaining a wide angle within the specular outer surface 35 of the reflector 31 which will be visible to a spectator.

What is claimed is:

1. A lamp comprising a battery housing, means for supporting a filament light bulb connectible to at least one cell within said battery housing, a head of clear transparent material mounted on said housing, and a reflector mounted within said head and having an exterior convex surface and a concave inner surface for reflecting light from the bulb along an exis, said head affording clear visibility of said exterior convex surface of said reflector, said head and said light bulb being axially movable relative to one another to an extent that at least part of the filament of said light bulb is withdrawn from within said concave inner surface of said reflector and light from said light bulb passes laterally through said head formed of transparent material.

2. A lamp according to claim 1, wherein said housing is cylindrical and said head comprises a cylindrical sleeve fitting closely on the housing.

3. A lamp according to claim 1, wherein said head comprises a frustoconical portion, said reflector being mounted within said frustoconical portion.

4. A lamp according to claim 3, wherein said reflector is a surface of revolution having a mouth, said mouth being located at the wide end of said frustoconical portion.

5. A lamp according to claim 1 wherein said head is of varying width and is formed with a non-circular section at the widest region thereof.

6. A lamp according to claim 5, wherein said non-circular section is polygonal.

7. A lamp according to claim 1 comprising a bulb supported in said bulb supporting means, said bulb having an integral converging lens for directing a beam along said axis independently of said reflector.

8. A lamp according to claim 1, comprising a bulb mounted in said bulb supporting means, said bulb extending through a central hole formed in said reflector which is of sufficient size to allow light from said bulb to pass therethrough out of said reflector, at least one of an end surface of said housing and of said bulb supporting means being a reflecting surface to reflect light from said bulb passing through said central hole.

9. A lamp according to claim 8, wherein said end surface is the end surface of said supply housing.

10. A lamp according to claim 1, wherein the exterior surface of the reflector is visible in all directions around said head except where obscured by at least one of said bulb supporting means and said housing.

11. A lamp according to claim 1, wherein at least part of said head of transparent material is colored.

12. A lamp according to claim 1, wherein said reflector is adapted specularly to reflect light falling on the exterior surface thereof.

13. A lamp according to claim 12, wherein said reflector is formed of transparent material coated with reflective material on the concave surface thereof.

14. A lamp according to claim 13, wherein said concave inner surface of said reflector is formed with a multiplicity of reflecting curved surface portions.

15. A lamp according to claim 1 wherein said exterior surface of said reflector is specularly reflecting.

16. A lamp according to claim 15 wherein said exterior surface of said reflector is convex and is formed with a multiplicity of reflecting curved surface portions.

17. A lamp according to claim 14 wherein said curved surface portions are convexities and have a height equal to from 3% to 25% of the mean smallest base diameter thereof.

18. A lamp according to claim 16 wherein said curved surface portions are concavities and have a height equal to from 3% to 25% of the mean smallest base diameter thereof.

* * * * *